US010145177B2

(12) United States Patent
Stokes

(10) Patent No.: US 10,145,177 B2
(45) Date of Patent: Dec. 4, 2018

(54) WELL DIVERTER ASSEMBLY WITH SUBSTANTIALLY PRESSURE BALANCED ANNULAR SEAL DEVICE

(71) Applicant: Halliburton Energy Services, Inc., Houston, TX (US)

(72) Inventor: Matthew B. Stokes, Keller, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 238 days.

(21) Appl. No.: 15/103,211

(22) PCT Filed: Jan. 15, 2014

(86) PCT No.: PCT/US2014/011605

§ 371 (c)(1),
(2) Date: Jun. 9, 2016

(87) PCT Pub. No.: WO2015/108512

PCT Pub. Date: Jul. 23, 2015

(65) Prior Publication Data

US 2016/0298391 A1 Oct. 13, 2016

(51) Int. Cl.

| | |
|---|---|
| ***E21B 7/06*** | (2006.01) |
| ***E21B 33/12*** | (2006.01) |
| *E21B 43/08* | (2006.01) |

(52) U.S. Cl.

CPC ..... *E21B 7/061* (2013.01); *E21B 33/1208* (2013.01); *E21B 43/08* (2013.01)

(58) Field of Classification Search

CPC . E21B 7/06; E21B 7/061; E21B 33/10; E21B 33/126; E21B 33/1208; E21B 43/08

See application file for complete search history.

(56) References Cited

U.S. PATENT DOCUMENTS 3,898,815 A 8/1975 Young
4,211,290 A * 7/1980 Mason ..... E21B 17/07 175/321

(Continued)

FOREIGN PATENT DOCUMENTS

CN 202451056 9/2012
CN 202970513 6/2013

(Continued)

OTHER PUBLICATIONS

International Search Report and Written Opinion of PCT Application No. PCT/US2014/011605 dated Oct. 21, 2014: pp. 1-13.

*Primary Examiner* — Brad Harcourt
*Assistant Examiner* — David Carroll
(74) *Attorney, Agent, or Firm* — Chamberlain Hrdlicka

(57) ABSTRACT

A diverter assembly can include a diverter having a deflection surface, and an annular seal device externally disposed and longitudinally displaceable on the assembly in response to a pressure differential being applied across the device. A well system can include a diverter assembly positioned in a casing, the assembly including a diverter and an annular seal device that seals off an annulus between the assembly and the casing, whereby a pressure differential across the device is reduced by movement of the device on the assembly. A method of sealing off an annulus formed between a diverter assembly and a casing can include positioning an annular seal device on a mandrel, the device being slidingly and sealingly engaged with an outer surface of the mandrel, connecting the mandrel to a diverter, and installing the assembly comprising the device, the mandrel and the diverter in the casing.

20 Claims, 4 Drawing Sheets

(56) References Cited

U.S. PATENT DOCUMENTS

| | | | | |
|---|---|---|---|---|
| 4,552,230 | A * | 11/1985 | Anderson | E21B 17/07 175/321 |
| 4,765,404 | A | 8/1988 | Bailey et al. | |
| 5,454,430 | A | 10/1995 | Kennedy et al. | |
| 5,474,126 | A | 12/1995 | Lynde et al. | |
| 5,762,143 | A | 6/1998 | Comeau et al. | |
| 6,047,774 | A | 4/2000 | Allen | |
| 9,376,882 | B2 | 6/2016 | Theiss et al. | |
| 2003/0042024 | A1* | 3/2003 | Freeman | E21B 7/061 166/313 |
| 2004/0069496 | A1 | 4/2004 | Hosie et al. | |
| 2004/0251023 | A1 | 12/2004 | Pluchek et al. | |
| 2005/0109502 | A1* | 5/2005 | Buc Slay | B82Y 30/00 166/179 |
| 2005/0230151 | A1 | 10/2005 | McGarian et al. | |
| 2007/0240877 | A1 | 10/2007 | O'Malley et al. | |
| 2008/0308283 | A1 | 12/2008 | Freyer | |
| 2009/0277648 | A1* | 11/2009 | Nutley | E21B 17/10 166/382 |
| 2012/0205092 | A1 | 8/2012 | Givens et al. | |
| 2012/0305267 | A1* | 12/2012 | Steele | E21B 41/0042 166/380 |

FOREIGN PATENT DOCUMENTS

| | | |
|---|---|---|
| CN | 103277050 | 9/2013 |
| CN | 103437704 | 12/2013 |
| RU | 2436931 | 12/2011 |
| RU | 2449107 | 4/2012 |
| WO | 2012166400 | 12/2012 |

* cited by examiner

WELL DIVERTER ASSEMBLY WITH SUBSTANTIALLY PRESSURE BALANCED ANNULAR SEAL DEVICE

TECHNICAL FIELD

This disclosure relates generally to equipment utilized and operations performed in conjunction with a subterranean well and, in one example described below, more particularly provides a well diverter assembly with a substantially pressure balanced annular seal device.

BACKGROUND

A diverter is typically used in a well to deflect equipment laterally relative to a wellbore in which the diverter is installed. Examples of diverters include milling and drilling whipstocks, and completion diverters. A milling whipstock can be used to deflect one or more mills laterally, in order to mill a window through casing lining the wellbore. A drilling whipstock can be used to deflect a drill string for drilling a lateral wellbore outward from the window. A completion deflector can be used to deflect completion assemblies (such as, liners, well screens, etc.) into the lateral wellbore. In some examples, a single diverter can perform more than one (or all) of these functions. It will, thus, be readily appreciated that improvements are continually needed in the arts of constructing and utilizing well diverter assemblies.

DETAILED DESCRIPTION

Figure 1:
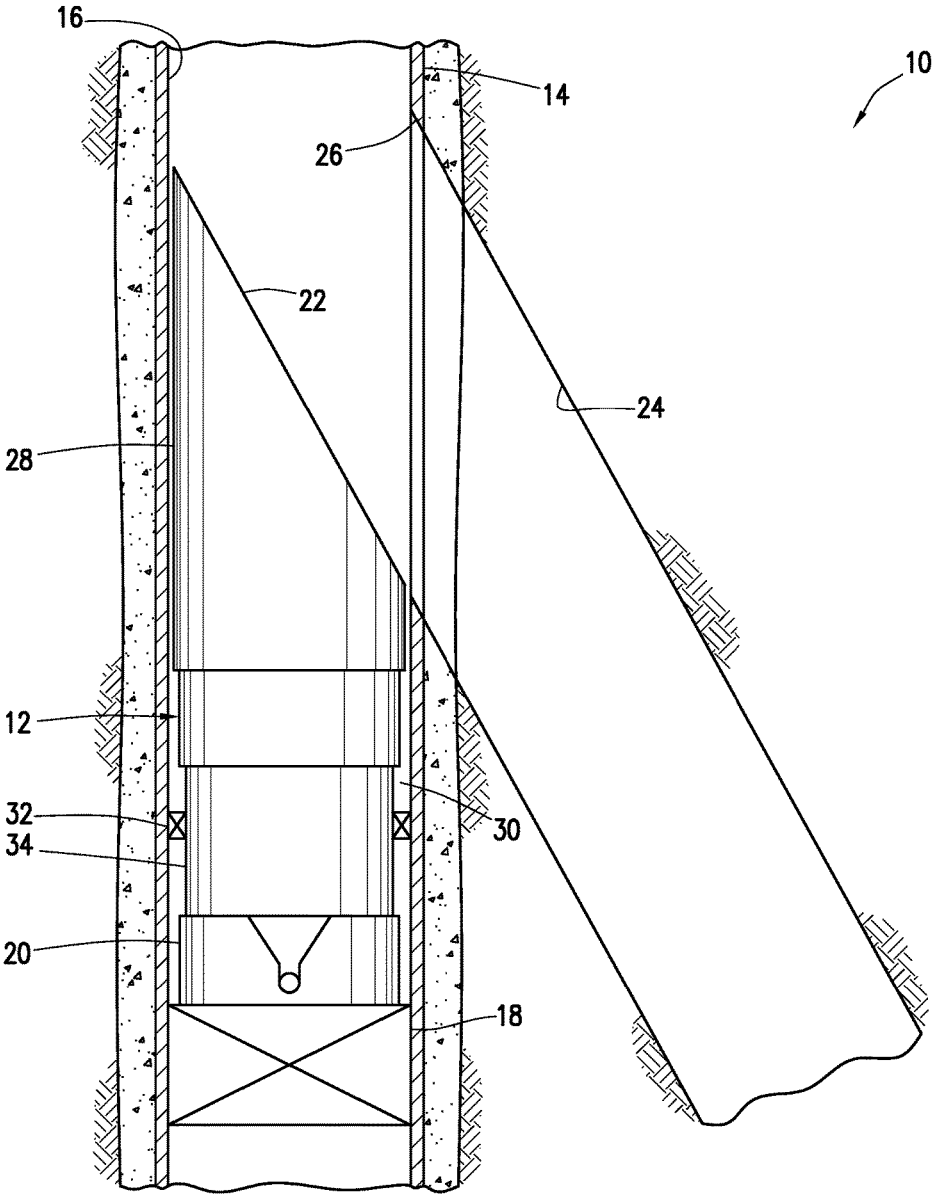
FIG. 1 is a representative partially cross-sectional view of a well system and associated method which can embody principles of this disclosure, the well system being depicted with a well diverter assembly installed in a parent wellbore, and a lateral wellbore having been drilled outwardly from the parent wellbore.

Representatively illustrated in FIG. 1 is a system 10 for use with a well, and an associated method, which can embody principles of this disclosure. However, it should be clearly understood that the system 10 and method are merely one example of an application of the principles of this disclosure in practice, and a wide variety of other examples are possible. Therefore, the scope of this disclosure is not limited at all to the details of the system 10 and method described herein and/or depicted in the drawings.

In the FIG. 1 example, a well diverter assembly 12 is installed in casing 14 which lines a main or parent wellbore 16. As used herein, the term "casing" is used to indicate a tubular protective wellbore lining. Casing can be in forms known to those skilled in the art as "casing," "liner" or "tubing." Casing can be segmented or continuous, metallic or non-metallic, and can be expanded or formed in situ. Thus, it should be appreciated that the scope of this disclosure is not limited to use of any particular type of casing.

The diverter assembly 12 is secured in the casing 14 by an anchoring device 18. The anchoring device 18 could be a packer, a latch which engages a latch coupling in the casing 14, or any other type of anchoring device capable of securing the diverter assembly 12 against longitudinal displacement in the casing.

In some examples, the anchoring device 18 could be part of the diverter assembly 12. In other examples, the anchoring device 18 could be installed in the casing 14, and then the diverter assembly 12 could be engaged with the anchoring device. In further examples, the anchoring device 18 could be installed as part of a diverter assembly, and then could remain in the casing 14 while a diverter of the assembly is exchanged for another diverter. Thus, it should be appreciated that the scope of this disclosure is not limited to any particular type of anchoring device, or to any particular procedure for installing the anchoring device, or to any particular combination of the anchoring device with a diverter assembly.

In the FIG. 1 example, an orienting device 20 is used to orient an inclined deflection surface 22 of the diverter assembly 12 azimuthally or rotationally toward a branch or lateral wellbore 24. At the time the orienting device 20 performs this orienting function, the lateral wellbore 24 may or may not have been drilled. For example, the orienting device 20 could be used to orient the deflection surface 22 in a desired azimuthal direction for milling a window 26 through the casing 14 and subsequently drilling the lateral wellbore 24 outwardly from the window.

Note that a separate orienting device 20 is not necessary in keeping with the scope of this disclosure. For example, the anchoring device 18 could perform the orienting function (e.g., with an oriented latch coupling in the casing 14, etc.). In other examples, the diverter assembly 12 could be oriented when it is installed using equipment such as a gyroscope, a low side indicator, etc. Thus, the scope of this disclosure is not limited to use of any particular type of orienting device, or to use of a separate orienting device with the diverter assembly 12.

The deflection surface 22 is formed on a diverter 28. In this example, the diverter 28 is of the type known to those skilled in the art as a completion diverter, but in other examples, the diverter could perform functions other than, or in addition to, deflecting completion equipment into the lateral wellbore 24. Thus, the scope of this disclosure is not limited to use of any particular type of diverter.

As depicted in FIG. 1, the parent wellbore 16 is vertical and the lateral wellbore 24 is drilled downwardly and outwardly from the window 26. However, in other examples, the parent wellbore 16 could be horizontal or inclined relative to vertical, the lateral wellbore 24 could be drilled upwardly, horizontally or in any other direction from the window 26, the parent wellbore could be a branch of another wellbore, etc. Thus, the scope of this disclosure is not limited to any of the details of the wellbores 16, 24 as depicted in the drawings or described herein.

During milling of the window 26, drilling of the lateral wellbore 24, completion operations, etc., debris can possibly displace through an annulus 30 formed radially between the diverter assembly 12 and the casing 14. This debris can hinder or prevent proper operation or retrieval of certain equipment. For example, debris in the annulus 30 could make it difficult to retrieve the diverter assembly 12, or could cause a latch of the orienting device 20 or anchoring device 18 to malfunction, etc.

In the diverter assembly 12 of FIG. 1, these unfortunate and undesired circumstances are mitigated by use of an annular seal device 32 on the diverter assembly 12. The annular seal device 32 seals off the annulus 30, and thereby prevents debris (such as, milling and drilling debris, cement, etc.) from displacing beyond the annular seal device.

In the FIG. 1 example, the annular seal device 32 is externally disposed on a mandrel 34 connected between the diverter 28 and the orienting device 20. The annular seal device 32 sealingly engages both the mandrel 34 and the casing 14 to thereby seal off the annulus 30.

The annular seal device 32 also slidingly engages the casing 14 and the mandrel 34, so that the annular seal device is longitudinally displaceable in the annulus 30 relative to the casing and mandrel. In this manner, pressure across the annular seal device 32 can remain substantially balanced, so that the annular seal device does not have to seal against a large pressure differential (which could otherwise shorten a useful life of the annular seal device). Thus, if a pressure differential is applied across the annular seal device 32, the annular seal device can displace longitudinally and thereby eliminate (or at least substantially reduce) the pressure differential.

Figure 2:
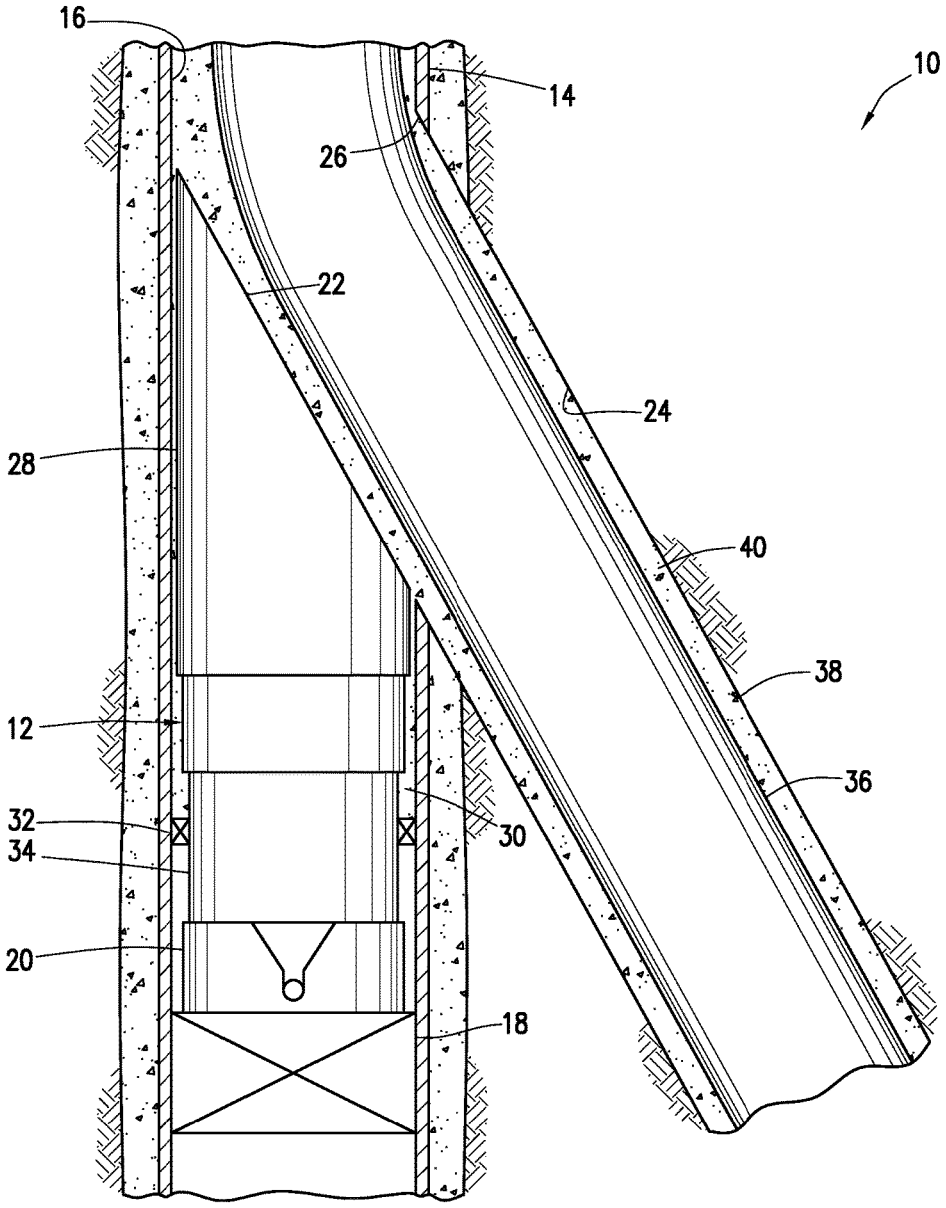
FIG. 2 is another representative partially cross-sectional view of the well system and method, the well system being depicted with a liner cemented in the lateral wellbore.

Referring additionally now to FIG. 2, the well system 10 is representatively illustrated after a liner 36 has been installed in the lateral wellbore 24. Cement 38 has been flowed into an annulus 40 formed radially between the liner 36 and the lateral wellbore 24.

The cement 38 also extends into the parent wellbore casing 14 via the window 26. In subsequent operations, a washover tool (not shown) may be used to cut off an upper end of the liner 36 and remove the diverter assembly 12, so that access is then permitted to the parent wellbore 16 below, but this is not necessary in keeping with the scope of this disclosure.

As depicted in FIG. 2, it can be seen that some of the cement 38 has entered the annulus 30 above the annular seal device 32. However, the annular seal device 32 prevents the cement 38 (or any other debris) from displacing further in the annulus 30.

If, for example, during the cementing operation, pressure in the annulus 30 above the annular seal device 32 is increased relative to pressure in the annulus below the annular seal device, the annular seal device can displace downward. This downward displacement of the annular seal device 32 will compress fluid in the annulus 30 and wellbore 16 below the annular seal device, thereby equalizing pressure across the annular seal device.

Figure 3:
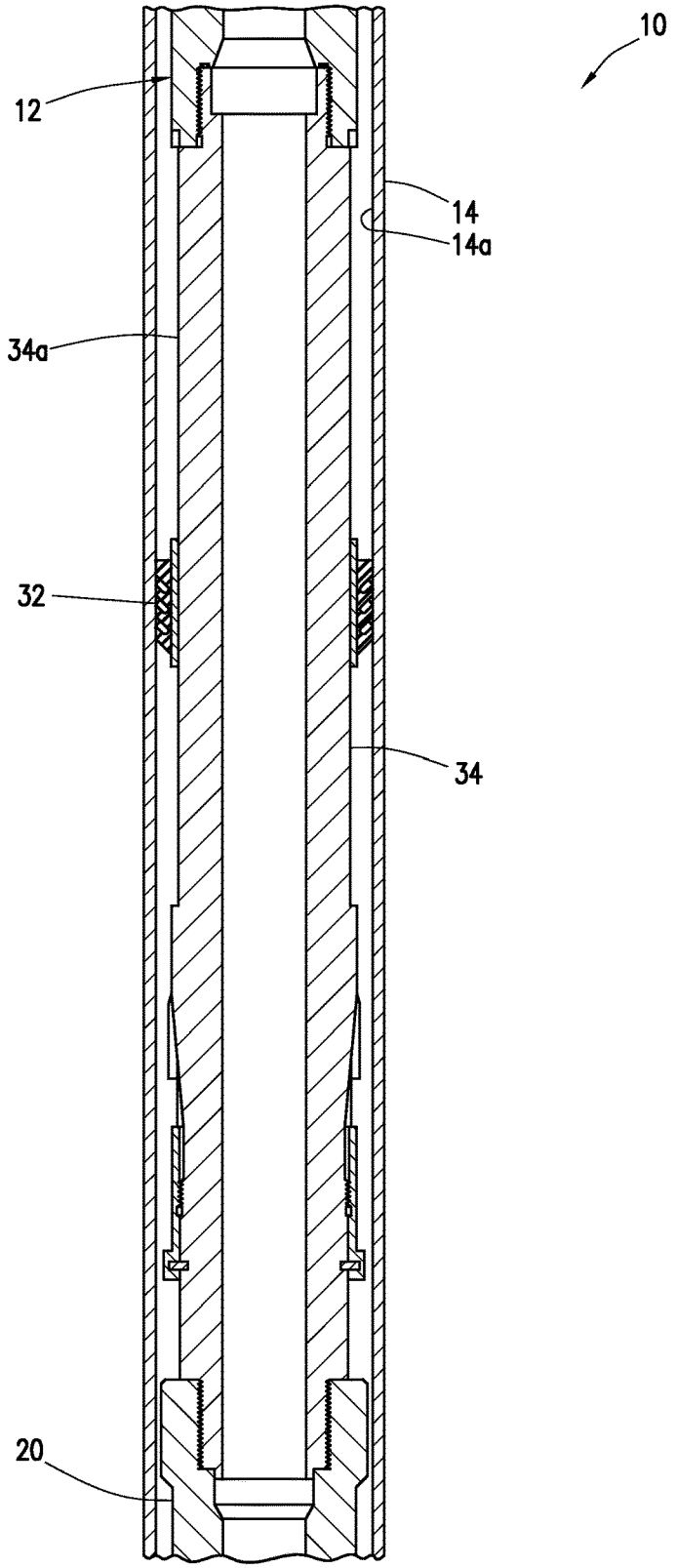
FIG. 3 is an enlarged scale representative cross-sectional view of an annular seal device and mandrel of the diverter assembly.

Referring additionally now to FIG. 3, an enlarged scale cross-sectional view of a portion of the diverter assembly 12 in the casing 14 is representatively illustrated. In this view, it may be seen that the annular seal device 32 is sealingly and slidingly disposed on a reduced diameter outer surface 34*a* of the mandrel 34. The annular seal device 32 also sealingly and slidingly engages an inner surface 14*a* of the casing 14.

Figure 4:
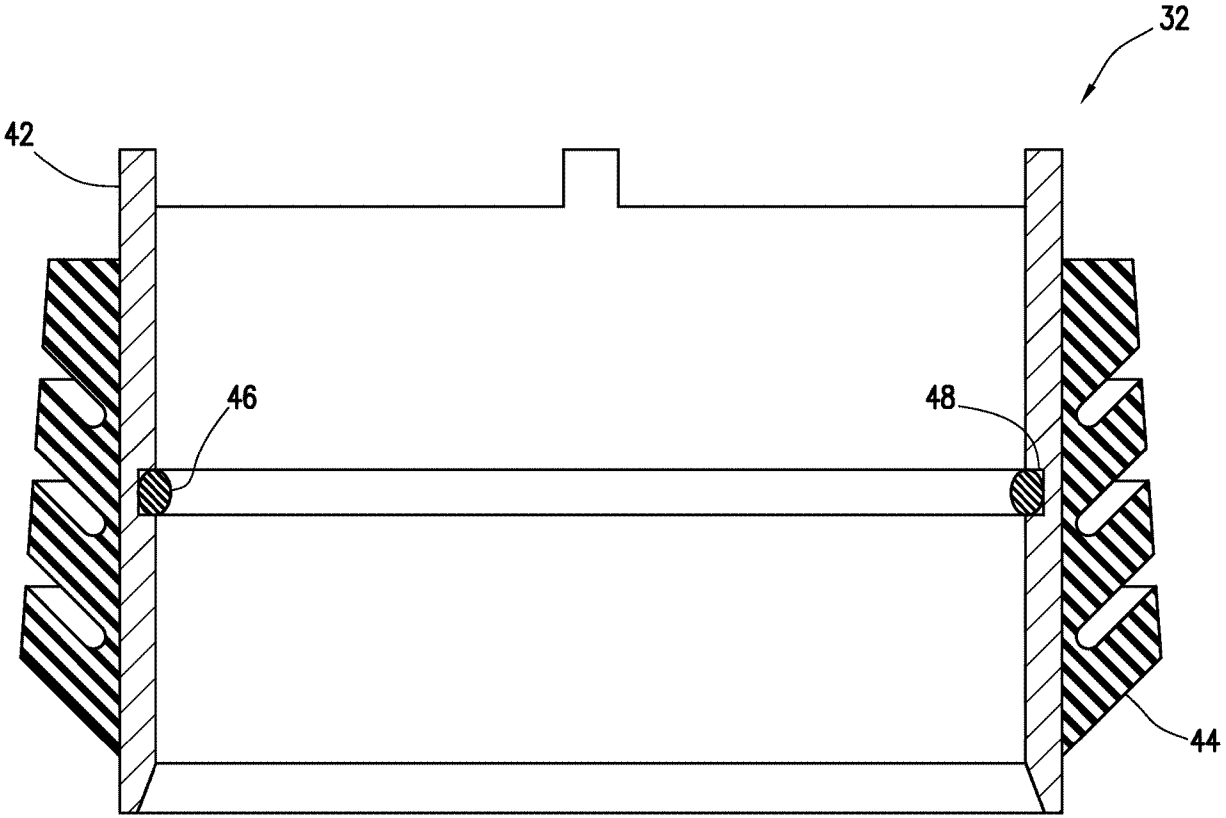
FIG. 4 is a further enlarged scale representative cross-sectional view of the annular seal device.

Referring additionally now to FIG. 4, a further enlarged scale cross-sectional view of the annular seal device 32 is representatively illustrated. In this view, it may be seen that the seal device 32 includes a generally tubular sleeve 42. A seal 44 is disposed externally on the sleeve 42 for sliding and sealing engagement with the casing inner surface 14*a*. Another seal 46 is disposed in a recess 48 formed internally in the sleeve 42, so that the seal can slidingly and sealingly engage the mandrel outer surface 34*a*.

In the FIG. 4 example, the seal 44 is molded or bonded onto the sleeve 42, and the seal 46 is retained in the recess 48. However, in other examples, both of the seals 44, 46 could be retained in recesses, or molded or bonded to the sleeve 42, or otherwise attached or secured. In some examples, the outer and inner seals 44, 46 could be integrally formed as a single component, with or without use of the sleeve 42. Thus, the scope of this disclosure is not limited to use of any particular type of seals, or to any particular construction of the annular seal device 32.

It may now be fully appreciated that the above disclosure provides significant advancements to the art of constructing and utilizing well diverter assemblies. In examples described above, the annular seal device 32 is capable of preventing displacement of debris (such as cement 38, etc.) through the annulus 30, without the annular seal device having to withstand a substantial pressure differential.

In one aspect, a well diverter assembly 12 is provided to the art by the above disclosure. In an example described above, the diverter assembly 12 can comprise a diverter 28 having a deflection surface 22, and an annular seal device 32 externally disposed on the well diverter assembly 12, the annular seal device 32 being longitudinally displaceable on the well diverter assembly 12 in response to a pressure differential being applied across the annular seal device 32.

Displacement of the annular seal device 32 on the well diverter assembly 12 may reduce the pressure differential, and/or substantially equalize pressure across the annular seal device 32.

The annular seal device 32 can be positioned longitudinally between the diverter 28 and an anchoring device 18 which secures the well diverter assembly 12 in a well casing 14. The annular seal device 32 sealingly and slidingly engages the well casing 14, and sealingly and slidingly engages a mandrel 34 connected to the diverter 28.

The annular seal device 32 can comprise a rigid sleeve 42 having a resilient first seal 44 on an exterior of the sleeve 42, and having a resilient second seal 46 on an interior of the sleeve 42.

The annular seal device 32 may prevent cement 38 on a first side of the annular seal device 32 from displacing to a second side of the annular seal device 32 opposite the first side.

Also described above is a well system 10. In one example, the well system 10 can comprise a well diverter assembly 12 positioned in a well casing 14, the well diverter assembly 12 including a diverter 28 and an annular seal device 32 that seals off an annulus 30 between the well diverter assembly 12 and the well casing 14. A pressure differential across the annular seal device 32 is reduced by movement of the annular seal device 32 on the well diverter assembly 12. The annular seal device 32 can move on the well diverter assembly 12 in response to application of the pressure differential across the annular seal device 32.

The above disclosure also provides to the art a method of sealing off an annulus 30 formed between a well diverter assembly 12 and a well casing 14. In one example, the method comprises: positioning an annular seal device 32 on a mandrel 34, the annular seal device 32 being slidingly and sealingly engaged with an outer surface 34*a* of the mandrel 34; connecting the mandrel 34 to a diverter 28; and installing the well diverter assembly 12 comprising the annular seal device 32, the mandrel 34 and the diverter 28 in the well casing 14.

The annular seal device 32 sealingly and slidingly engages the well casing 14 after the installing step.

The method can include applying a pressure differential across the annular seal device 32 after the installing step, thereby causing the annular seal device 32 to displace in the annulus 30. Displacement of the annular seal device 32 in the annulus 30 may reduce the pressure differential.

Although various examples have been described above, with each example having certain features, it should be understood that it is not necessary for a particular feature of one example to be used exclusively with that example. Instead, any of the features described above and/or depicted in the drawings can be combined with any of the examples, in addition to or in substitution for any of the other features of those examples. One example's features are not mutually exclusive to another example's features. Instead, the scope of this disclosure encompasses any combination of any of the features.

Although each example described above includes a certain combination of features, it should be understood that it is not necessary for all features of an example to be used. Instead, any of the features described above can be used, without any other particular feature or features also being used.

It should be understood that the various embodiments described herein may be utilized in various orientations, such as inclined, inverted, horizontal, vertical, etc., and in various configurations, without departing from the principles of this disclosure. The embodiments are described merely as examples of useful applications of the principles of the disclosure, which is not limited to any specific details of these embodiments.

In the above description of the representative examples, directional terms (such as "above," "below," "upper," "lower," etc.) are used for convenience in referring to the accompanying drawings. However, it should be clearly understood that the scope of this disclosure is not limited to any particular directions described herein.

The terms "including," "includes," "comprising," "comprises," and similar terms are used in a non-limiting sense in this specification. For example, if a system, method, apparatus, device, etc., is described as "including" a certain feature or element, the system, method, apparatus, device, etc., can include that feature or element, and can also include other features or elements. Similarly, the term "comprises" is considered to mean "comprises, but is not limited to."

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of this disclosure. For example, structures disclosed as being separately formed can, in other examples, be integrally formed and vice versa. Accordingly, the foregoing detailed description is to be clearly understood as being given by way of illustration and example only, the spirit and scope of the invention being limited solely by the appended claims and their equivalents.

What is claimed is:

1. A well diverter assembly, comprising:

a diverter having a deflection surface; and an annular seal device externally disposed on the well diverter assembly, the annular seal device being longitudinally displaceable on the well diverter assembly in response to a pressure differential being applied across the annular seal device.

2. The well diverter assembly of claim 1, wherein displacement of the annular seal device on the well diverter assembly reduces the pressure differential.

3. The well diverter assembly of claim 1, wherein displacement of the annular seal device on the well diverter assembly substantially equalizes pressure across the annular seal device.

4. The well diverter assembly of claim 1, wherein the annular seal device is positioned longitudinally between the diverter and an anchoring device which secures the well diverter assembly in a well casing.

5. The well diverter assembly of claim 4, wherein the annular seal device sealingly and slidingly engages the well casing, and wherein the annular seal device sealingly and slidingly engages a mandrel connected to the diverter.

6. The well diverter assembly of claim 1, wherein the annular seal device comprises a rigid sleeve having a resilient first seal on an exterior of the sleeve, and having a resilient second seal on an interior of the sleeve.

7. The well diverter assembly of claim 1, wherein the annular seal device prevents cement on a first side of the annular seal device from displacing to a second side of the annular seal device opposite the first side.

8. A well system, comprising:

a well diverter assembly positioned in a well casing, the well diverter assembly including a diverter and an annular seal device that seals off an annulus between the well diverter assembly and the well casing, wherein a pressure differential across the annular seal device is reduced by movement of the annular seal device on the well diverter assembly.

9. The well system of claim 8, wherein the annular seal device moves on the well diverter assembly in response to application of the pressure differential across the annular seal device.

10. The well system of claim 8, wherein displacement of the annular seal device on the well diverter assembly substantially equalizes pressure across the annular seal device.

11. The well system of claim 8, wherein the annular seal device is positioned longitudinally between the diverter and an anchoring device which secures the well diverter assembly in the well casing.

12. The well system of claim 8, wherein the annular seal device sealingly and slidingly engages the well casing, and wherein the annular seal device sealingly and slidingly engages a mandrel connected to the diverter.

13. The well system of claim 8, wherein the annular seal device comprises a rigid sleeve having a resilient first seal on an exterior of the sleeve, and having a resilient second seal on an interior of the sleeve.

14. The well system of claim 8, wherein the annular seal device prevents cement on a first side of the annular seal device from displacing to a second side of the annular seal device opposite the first side.

15. A method of sealing off an annulus formed between a well diverter assembly and a well casing, the method comprising:

positioning an annular seal device on a mandrel, the annular seal device being slidingly and sealingly engaged with an outer surface of the mandrel;

connecting the mandrel to a diverter; and installing the well diverter assembly in the well casing, the well diverter assembly comprising the annular seal device, the mandrel and the diverter.

16. The method of claim 15, wherein the annular seal device sealingly and slidingly engages the well casing after the installing.

17. The method of claim 15, further comprising applying a pressure differential across the annular seal device after the installing, thereby causing the annular seal device to displace in the annulus.

18. The method of claim 17, wherein displacement of the annular seal device in the annulus reduces the pressure differential.

19. The method of claim 15, wherein the annular seal device prevents cement on a first side of the annular seal device from displacing to a second side of the annular seal device opposite the first side.

20. The method of claim 15, wherein the annular seal device is positioned longitudinally between the diverter and an anchoring device which secures the well diverter assembly in the well casing.

* * * * *